US006482034B2

(12) United States Patent
Ozaki

(10) Patent No.: US 6,482,034 B2
(45) Date of Patent: Nov. 19, 2002

(54) CONNECTION STRUCTURE FOR ELECTRIC WIRE AND TERMINAL, CONNECTION METHOD THEREFOR AND TERMINAL CONNECTING APPARATUS

(75) Inventor: Masahito Ozaki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/733,053

(22) Filed: Dec. 11, 2000

(65) Prior Publication Data

US 2001/0004569 A1 Jun. 21, 2001

(30) Foreign Application Priority Data

Dec. 14, 1999 (JP) ..... 11-354996

(51) Int. Cl.[7] ..... H01R 9/05

(52) U.S. Cl. ..... 439/585; 439/585; 439/578; 439/860; 439/877; 439/399; 439/865; 174/74 R; 174/74 C; 174/78

(58) Field of Search ..... 439/578–571, 439/585, 877, 867, 324, 399; 29/899, 865–861, 854–57; 174/74 R, 75 C, 78

(56) References Cited

U.S. PATENT DOCUMENTS

| | | | | | |
|---|---|---|---|---|---|
| 3,662,089 A | | 5/1972 | Harding | 174/84 C |
| 3,670,293 A | * | 6/1972 | Garver | 439/585 |
| 3,937,403 A | * | 2/1976 | Lawson | 439/424 |
| 4,010,538 A | * | 3/1977 | O'Keefe et al. | 29/630 |
| 5,114,366 A | * | 5/1992 | Sato | 439/585 |
| 5,246,384 A | * | 9/1993 | Sato | 439/585 |
| 6,065,998 A | * | 5/2000 | Peloza | 439/578 |

FOREIGN PATENT DOCUMENTS

| | | | | |
|---|---|---|---|---|
| DE | 1 540 640 | | 1/1964 | |
| EP | 0000996 | * | 3/1979 | 439/585 |
| EP | 0 793 311 A2 | | 9/1997 | |
| EP | 0 793 311 A3 | | 7/1998 | |
| GB | 1008995 | | 11/1965 | |
| GB | 1 281 198 | | 7/1972 | |
| JP | 61-253774 | | 11/1996 | |

* cited by examiner

*Primary Examiner*—Tho D. Ta
*Assistant Examiner*—Larisa Z Tsukerman
(74) *Attorney, Agent, or Firm*—Finnegan, Henderson, Farabow, Garrett & Dunner, L.L.P.

(57) ABSTRACT

In a connecting structure for an electric wire 1 and a terminal 8 in which an insulative outer skin 5 of the electric wire is mounted to an electric wire cover crimping portion 11 of the terminal 8, and the terminal 8 is connected to the electric wire, wherein the electric wire cover crimping portion 11 is formed with a hole 14, and an opening peripheral edge 14*a* of the hole 14 is allowed to bite into the insulative outer skin 5.

2 Claims, 5 Drawing Sheets

CONNECTION STRUCTURE FOR ELECTRIC WIRE AND TERMINAL, CONNECTION METHOD THEREFOR AND TERMINAL CONNECTING APPARATUS

BACKGROUND OF THE INVENTION

1. Field of the Invention

The present invention relates to a connection structure for an electric wire and a terminal, a connection method therefor and a terminal connecting apparatus, and more particularly, to a connection structure for an electric wire and a terminal, a connection method therefor and a terminal connecting apparatus capable of strongly connecting the electric wire and the terminal irrespective of plate thickness and strength of the terminal and capable of reducing variation of crimp at the time of swaging.

2. Description of the Related Art

As one method for connecting a terminal to an electric wire, a method disclosed in Japanese Patent Application Laid-open No. S61-253774 is proposed. According to this method, as shown in FIGS. 1A and 1B, an electric wire cover crimping portion 102 of a terminal 101 is formed with an incision 103 of substantially U-shape as viewed from top. Portions of the terminal 101 facing the incision 103 are bent inward to form biting pieces 104 and 104. The biting pieces 104 and 104 are allowed to bite into an insulative outer skin 105 of the electric wire as shown in FIG. 1C so as to swag the electric wire cover crimping portion 102 together with the insulative outer skin 105.

Since the electric wire cover crimping portion 102 is swaged with the insulative outer skin 105 of the electric wire and at the same time, the biting pieces 104 and 104 bite into the insulative outer skin 105 in this manner, the terminal 101 can be connected to the electric wire with one swaging operation. Further, since the biting pieces 104 and 104 bite into the insulative outer skin 105, connecting and holding force of the terminal 101 and the electric wire is enhanced.

However, the biting pieces 104 and 104 need to have strength enough to withstand pressure when swaging the electric wire cover crimping portion 102 and it is necessary to increase thickness of the pieces 104 and 104. Further, since the biting pieces 104 and 104 are formed by bending using a mold, it is troublesome to form the pieces as compared with a terminal having no biting pieces 104 and 104, and cost of the mold is also high. The terminal 101 may be deviated right/left and forward/backward with respect to the electric wire in some cases, and this causes variation at the time of swaging.

Thereupon, the present invention has been achieved to solve the above problems, and it is an object of the invention to provide a connection structure for an electric wire and a terminal, a connection method therefor and a terminal connecting apparatus capable of strongly connecting the terminal to the electric wire by allowing the terminal to uniformly bite into an insulative outer skin of the electric wire irrespective of relation of thickness and strength of the terminal, and capable of preventing positional deviation between the terminal and the electric wire at the time of swaging.

SUMMARY OF THE INVENTION

To achieve the above object, a first aspect of the present invention provides connecting structure for an electric wire and a terminal, comprising an insulative outer skin provided on the electric wire, an electric wire cover crimping portion provided on the terminal, and a hole formed in the electric wire cover crimping portion, wherein when the terminal is connected to the electric wire, the insulative outer skin is mounted to the electric wire cover crimping portion, the electric wire cover crimping portion is swaged and at the same time, an opening peripheral edge a of the hole is allowed to bite into the insulative outer skin.

Since the opening peripheral edge a of the hole formed in the electric wire cover crimping portion of the terminal is allowed to bites into the insulative outer skin of the electric wire in this manner, the biting piece of the opening peripheral edge a becomes an edge, and the holding force between the terminal and the electric wire is further enhanced.

A second aspect of the present invention provides a connecting method for an electric wire and a terminal, wherein an electric wire cover crimping portion of the terminal is formed with a hole and then, an insulative outer skin of the electric wire is mounted to the electric wire cover crimping portion, the electric wire cover crimping portion is swaged and at the same time, a projection is allowed to face the hole to project the projection upward toward the insulative outer skin, thereby allowing an opening peripheral edge a of the hole to bite into the insulative outer skin.

If the projection facing the hole formed in the electric wire cover crimping portion is pushed upward toward the insulative outer skin, the opening peripheral edge a of the hole is pushed upward toward the insulative outer skin, and the pushed up portion thereof becomes a biting piece, thereby securing the terminal and the electric wire to each other. Since a tip end the biting piece at that time becomes the edge, the opening peripheral edge a bites into the insulative outer skin strongly, and the holding force of the terminal and the electric wire is further enhanced.

Further, the electric wire cover crimping portion is swaged and at the same time, the opening peripheral edge a of the hole is pushed up by the projection. Therefore, it is possible to allow the biting piece of the opening peripheral edge a to bite uniformly irrespective of thickness and strength of the terminal. Further, the projection faces the hole and thus, positioning between the terminal and the electric wire is carried out when the electric wire cover crimping portion is swaged. When the electric wire cover crimping portion is swaged, positional deviation of the terminal and the electric wire right/left and forward/backward is restricted and variation by crimping is also restrained.

The terminal is only required to have the hole, it is unnecessary to form the terminal into a complicated shape unlike the conventional terminal, the number of manufacturing steps of the terminal can be reduced, and the costs can also be lowered.

A third aspect of the present invention provides a terminal connecting apparatus comprising a terminal mount for mounting the terminal having an electric wire cover crimping portion formed with a hole in a state in which the hole faces a projection, and a swaging member for swaging the electric wire cover crimping portion of the terminal mounted to the terminal mount into an insulative outer skin of the electric wire, wherein the electric wire cover crimping portion is swaged with the insulative outer skin by the swaging member and at the same time, an opening peripheral edge a of the hole is allowed to bite into the insulative outer skin.

In this apparatus of the invention, since the projection facing the hole formed in the terminal is formed on the terminal mount, the projection faces the hole and the terminal is positioned with respect to the terminal mount, and positional deviation between the terminal and the electric wire is prevented when the electric wire cover crimping portion is swaged.

BRIEF DESCRIPTION OF THE DRAWINGS

FIGS. 1 show a conventional terminal, wherein

FIGS. 7 show the terminal mounted to a terminal mount before the terminal is swaged, wherein FIGS. 8 show the terminal mounted to a terminal mount when the terminal is swaged, wherein

DETAILED DESCRIPTION OF THE PREFERRED EMBODIMENTS

A concrete embodiment to which the present invention is applied will be explained below in detail with reference to the drawings. First, a connection structure between an electric wire and a terminal of the present embodiment will be explained and then, a connection method therefor and a terminal connecting apparatus will be explained.

This embodiment will be explained based on a shield electric wire such as a coaxial cable as an electric wire to be connected to a terminal.

"CONNECTION STRUCTURE BETWEEN ELECTRIC WIRE AND TERMINAL"

<Structure of Shield Electric wire>

Figure 1A:
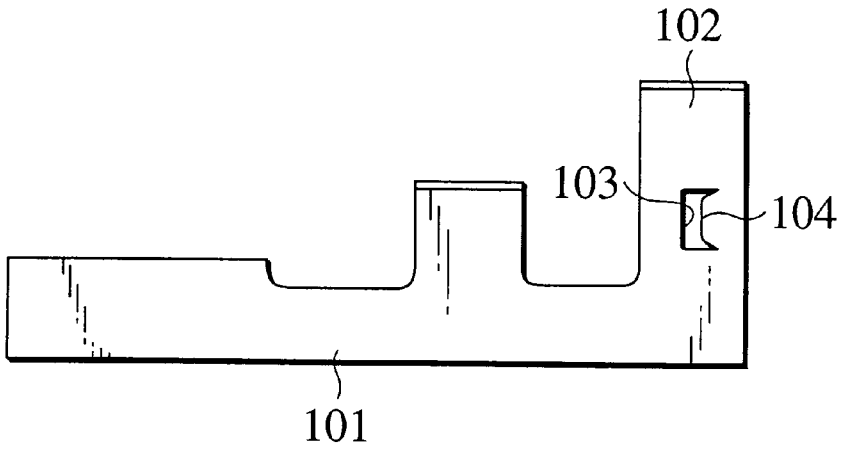
FIG. 1A is a side view.
Figure 1B:
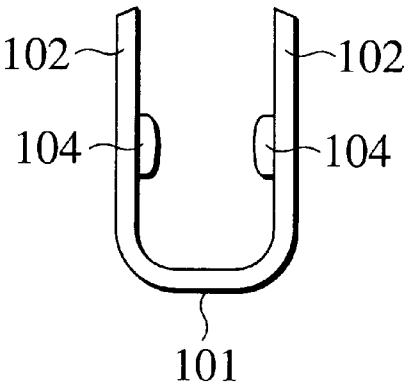
FIG. 1B is a front view and FIG. 1C is a front view showing the terminal swaging an electric wire.
Figure 1C:
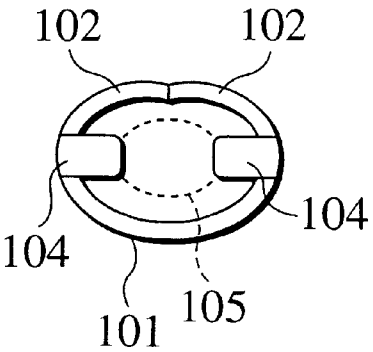
Figure 2:
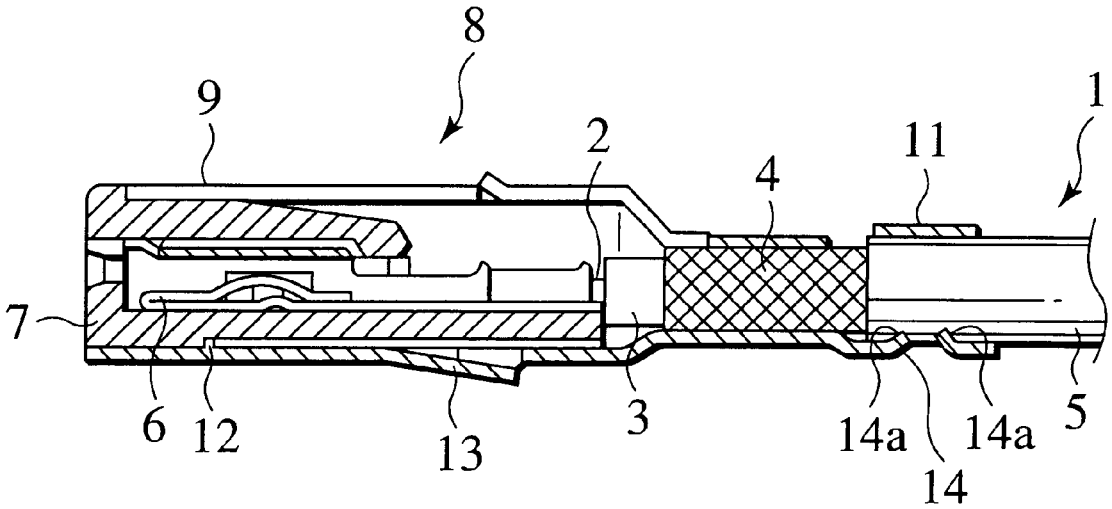
FIG. 2 is a sectional view showing a connection structure between an electric wire and a terminal of the present embodiment.

As shown in FIG. 2, a shield electric wire 1 comprises a core wire 2 comprising a conductive body, an insulative inner skin 3 for covering the core wire 2, a braided wire 4 provided around the insulative inner skin 3 such as to cover the latter, and an insulative outer skin 5 provided around the braided wire 4 such as to cover the core wire 2, the insulative inner skin 3 and the braided wire 4.

As shown in FIG. 2, a terminal hardware 6 that is a female terminal is swaged and mounted to a tip end of the core wire 2. The terminal hardware 6 is accommodated in a terminal accommodating chamber of a housing 7 formed of insulative material.

<Structure of Terminal>

Figure 4:
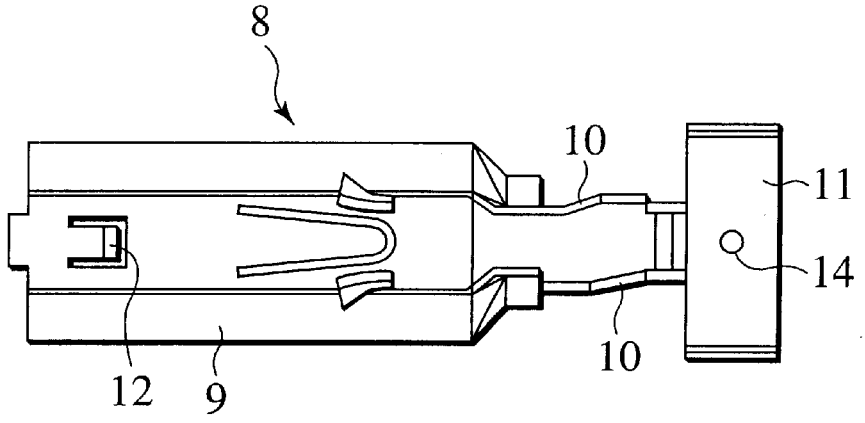
FIG. 4 is a plan view of the terminal shown in FIG. 1.

As shown in FIGS. 2 and 4, a terminal 8 comprises a partner terminal connecting portion 9 for accommodating the housing 7 therein, a braided wire holding portion 10 for holding the braided wire 4, and an electric wire cover crimping portion 11 for swaging the insulative outer skin 5.

The partner terminal connecting portion 9 is formed into a box-like shape, and a portion of a ceiling of the box-like shape is opened so that the terminal hardware 6 is accommodated in the partner terminal connecting portion 9. This partner terminal connecting portion 9 is formed with a housing-falling out preventing piece 12 for preventing the housing 7 from falling out from the partner terminal connecting portion 9. The housing-falling out preventing piece 12 is directed upward. The partner terminal connecting portion 9 is formed with a lance 13 engaging an outer housing that is assied with the terminal 8 or a lance 13 engaging the housing.

The braided wire holding portion 10 is formed between the partner terminal connecting portion 9 and the electric wire cover crimping portion 11 so that the braided wire 4 is swaged by a pair of braided wire grasping pieces.

Figure 3:
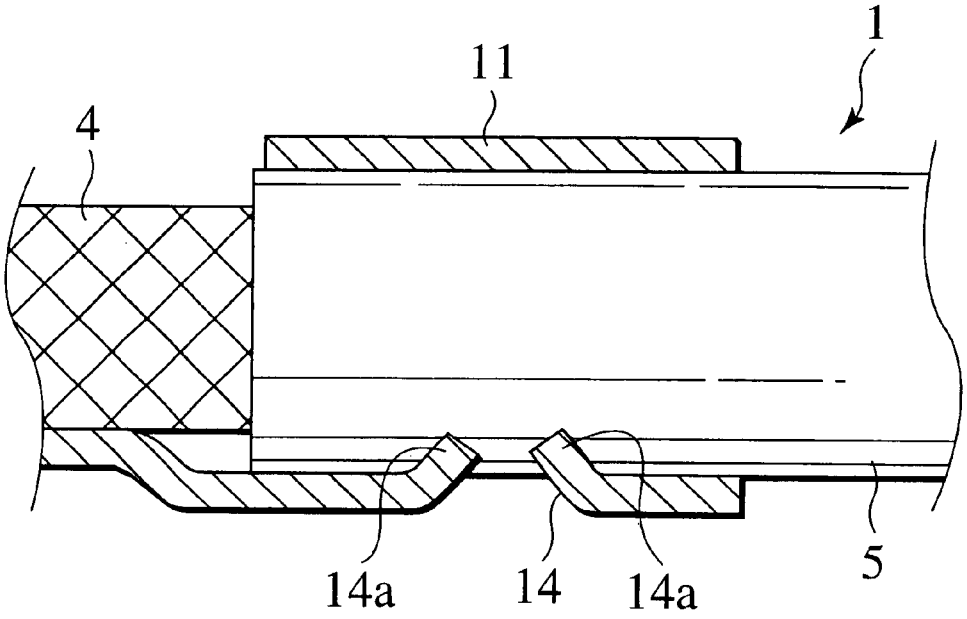
FIG. 3 is an enlarged sectional view of an essential portion of an electric wire cover crimping portion shown in FIG. 1.

The electric wire cover crimping portion 11 has a pair of outer skin grasping pieces for swaging the insulative outer skin 5, and the insulative outer skin 5 is swaged by the pair of outer skin grasping pieces. As shown in FIG. 3, the electric wire cover crimping portion 11 is formed with a hole 14 having an opening peripheral edge 14*a* presenting a substantially smooth surface that is configured to be deformed into a biting portion for strongly connecting the shield electric wire 1 and the terminal 8 to each other. A projection 15 (which will be described later) is brought to face the hole 14 and projected upward toward the insulative outer skin 5, thereby allowing an opening peripheral edge 14*a* to bite into the insulative outer skin 5.

By projecting the projection 15 into the hole 14 to allow the opening peripheral edge 14*a* of the hole 14 to bite into the insulative outer skin 5 in this manner, the biting piece of the opening peripheral edge 14*a* becomes an edge, and the holding force between the shield electric wire 1 and the terminal 8 is further enhanced.

"STRUCTURE OF TERMINAL CONNECTING APPARATUS"

Figure 7B:
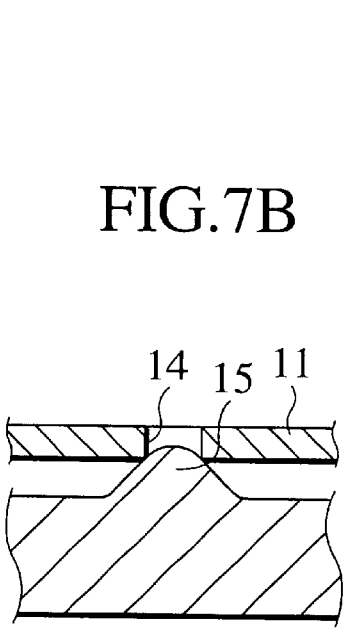
FIG. 7A is a sectional view and FIG. 7B is an enlarged sectional view in a state in which a projection faces a hole.

Next, the terminal connecting apparatus for connecting the electric wire and the terminal constituted as described above will be explained. As shown in FIGS. 7 and 8, the terminal connecting apparatus comprises a terminal mount 16 for mounting the terminal 8 having the electric wire cover crimping portion 11 formed with the hole 14 in a state in which the projection 15 faces the hole 14, and a swaging member 17 for swaging the electric wire cover crimping portion 11 of the terminal 8 with the insulative outer skin 5 of the shield electric wire 1.

<Structure of Terminal Mount>

Figure 5:
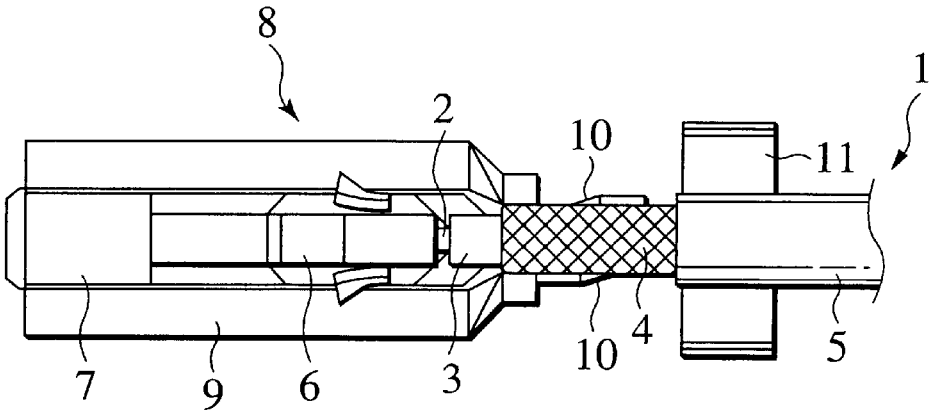
FIG. 5 is a plane view of the terminal shown in FIG. 1 to which the electric wire is set.
Figure 6:
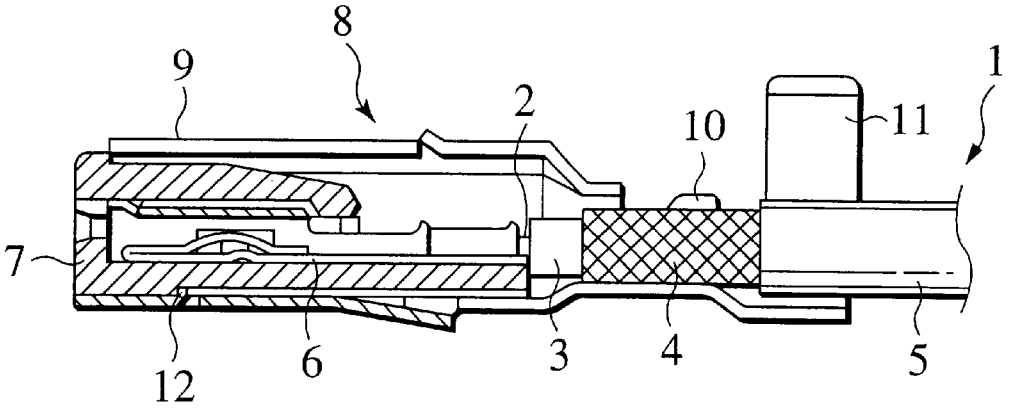
FIG. 6 is a sectional view of FIG. 5.

As shown in FIGS. 5 and 6, the terminal mount 16 is formed with a placing surface on which the terminal 8 is placed in a state in which the shield electric wire 1 is set. The placing surface comprises a partner terminal connecting portion placing surface 16*a*, and a braided wire holding portion placing surface 16*b* on which a portion of the terminal corresponding to the braided wire holding portion 10 is placed.

The terminal mount 16 is formed with the projection 15 facing the hole 14 formed in the electric wire cover crimping portion 11 of the terminal 8. As shown in FIG. 7, the projection 15 is formed into a mountain-like shape, and a tip end thereof faces the hole 14.

<Structure of Swaging Member>

Figure 7A:
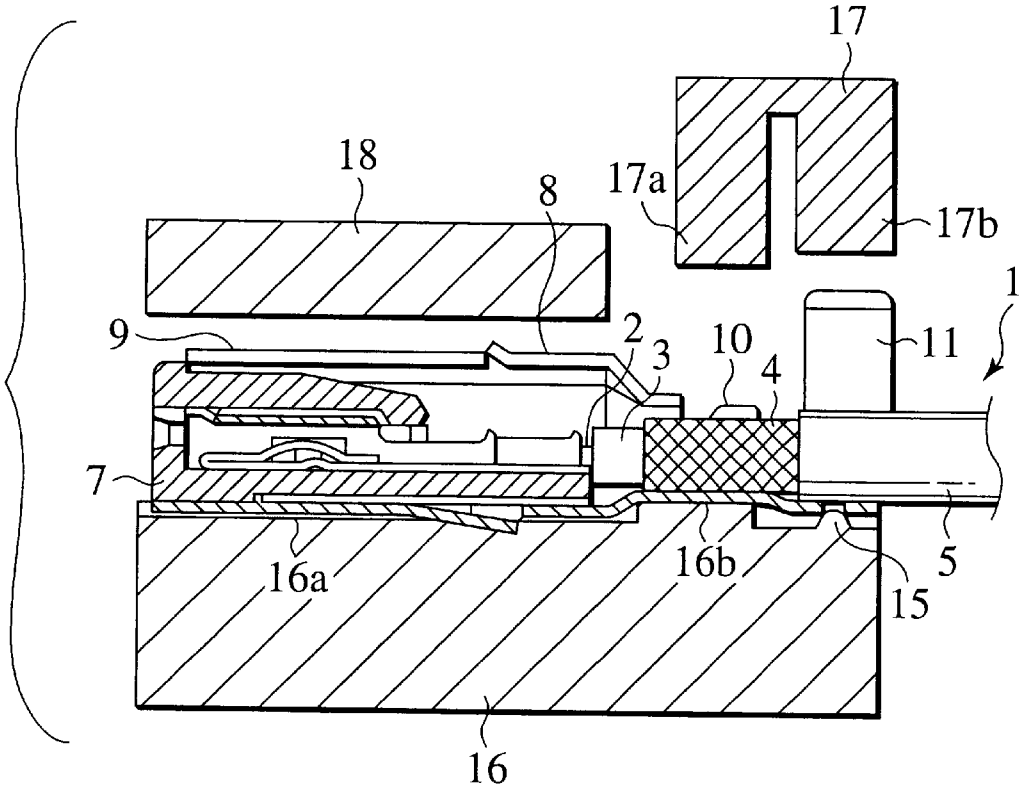
Figure 8B:
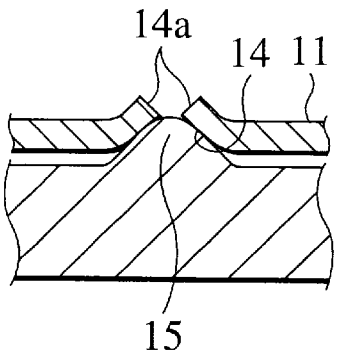
FIG. 8A is a sectional view and FIG. 8B is an enlarged sectional view in a state in which an outer peripheral edge of the hole bites into the insulative outer skin.
Figure 8A:
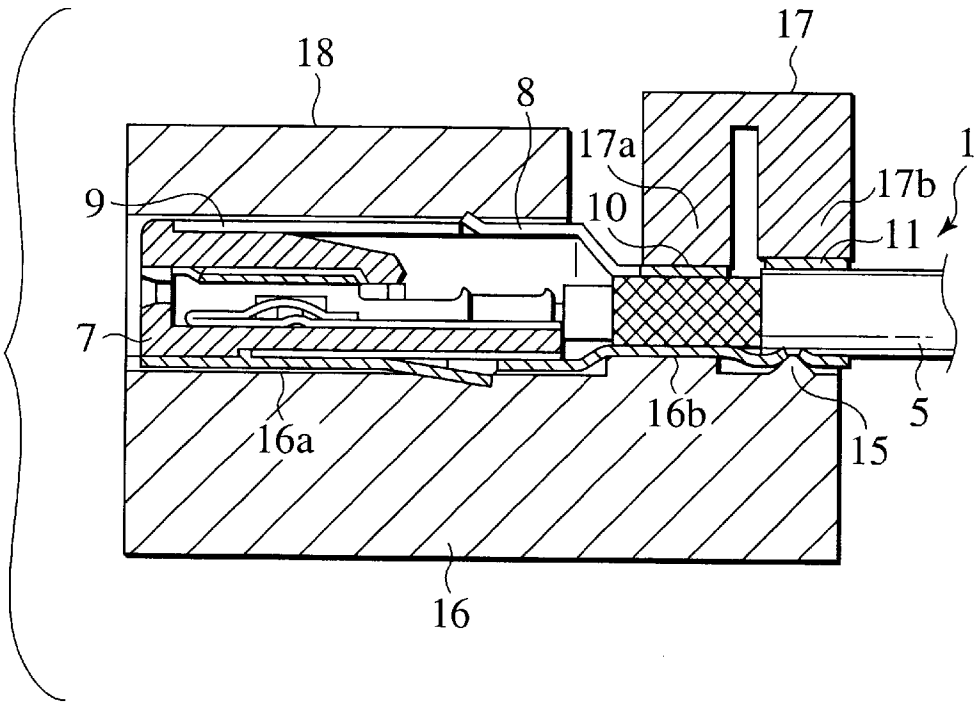

As shown in FIG. 7A, the terminal mount 16 is formed with a placing surface on which the terminal 8 is placed in a state in which the shield electric wire 1 is set. The placing surface comprises a partner terminal connecting portion placing surface 16*a*, and a braided wire holding portion placing surface 16*b* on which a portion of the terminal corresponding to the braided wire holding portion 10 is placed.

Further, when the braided wire holding portion 10 and the electric wire cover crimping portion 11 are swaged together by the swaging member 17, a terminal pressing member 18 for pressing the terminal 8 to prevent the latter from floating up is used.

"CONNECTING METHOD BETWEEN ELECTRIC WIRE AND TERMINAL"

Next, the connecting method between the electric wire and the terminal will be explained with reference to the drawings. First, the shield electric wire 1 is mounted to the terminal 8 as shown in FIGS. 5 and 6 and then, the terminal 8 is placed on the placing surface of the terminal mount 16 as shown in FIG. 7. At that time, the hole 14 formed in the electric wire cover crimping portion 11 faces the projection 15 provided on the terminal mount 16. With this operation, the terminal 8 is positioned with respect to the terminal mount 16.

Next, as shown in FIG. 8, the partner terminal connecting portion 9 is pressed by the terminal pressing member 18 and in this state, the electric wire cover crimping portion 11 is swaged by the swaging member 17. At the same time, the projection 15 facing the hole 14 is projected upward toward the insulative outer skin 5, thereby allowing the opening peripheral edge 14*a* of the hole 14 to bite into the insulative outer skin 5.

When the projection 15 facing the hole 14 formed in the electric wire cover crimping portion 11 is projected upward toward the insulative outer skin 5 of the shield electric wire 1, the opening peripheral edge 14*a* of the hole 14 is pushed upward toward the insulative outer skin 5, the pushed up portion becomes the biting piece to secure the terminal 8 and the shield electric wire 1 to each other. Since the tip end of the biting piece at that time becomes the edge, the biting piece strongly bites into the insulative outer skin 5, thereby further enhancing the holding force of the terminal 8 and the shield electric wire 1. Further, since the opening peripheral edge 14*a* of the hole 14 is pushed up by the projection 15, it is possible to allow the biting piece of the opening peripheral edge 14*a* to bite uniformly irrespective of thickness and strength of the terminal 8.

Although the concrete embodiment to which the present invention is applied is explained above, the invention should not be limited to this embodiment, and various modifications can be made.

Although the embodiment is explained while taking the shield electric wire as an example of electric wire, the electric wire is not limited to the shield electric wire.

What is claimed is:

1. A connecting structure for an electric wire and a terminal, comprising an insulative outer skin provided on said electric wire, an electric wire cover crimping portion provided on said terminal, and a hole formed in said electric wire cover crimping portion, the hole having an opening peripheral edge presenting a substantially smooth surface, wherein when said terminal is connected to said electric wire, said insulative outer skin is mounted to said electric wire cover crimping portion, said electric wire cover crimping portion is swaged and at the same time, the opening peripheral edge of said hole is deformed, thereby causing the opening peripheral edge to bite into said insulative outer skin.

2. A connecting structure for connecting an electric wire and a terminal, the connecting structure comprising:

a terminal connecting portion for accommodating a housing;

a wire holding portion for retaining the wire; and a wire crimping portion for swaging the wire, the wire crimping portion comprising a hole having an opening peripheral edge presenting a substantially smooth surface, wherein the opening peripheral edge is configured to be deformed into a biting portion upon receipt of a projection, thereby resulting in a secure engagement between the biting portion and the wire.

* * * * *